US007502577B2

(12) United States Patent
Kitozaki et al.

(10) Patent No.: US 7,502,577 B2
(45) Date of Patent: Mar. 10, 2009

(54) IMAGE FORMING APPARATUS COMPRISING A PLURALITY OF IMAGE FORMING STATIONS AND PLURALITY OF DEVELOPER ACCOMMODATING VESSELS

(75) Inventors: Yukihiro Kitozaki, Kashiwa (JP); Atsushi Munakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/151,307

(22) Filed: Jun. 14, 2005

(65) Prior Publication Data

US 2005/0281591 A1 Dec. 22, 2005

(30) Foreign Application Priority Data

Jun. 16, 2004 (JP) ..... 2004-178621
Apr. 12, 2005 (JP) ..... 2005-114238

(51) Int. Cl.
*G03G 15/08* (2006.01)

(52) U.S. Cl. ..... 399/258; 399/224

(58) Field of Classification Search ..... 399/258, 399/223, 224, 299, 360
See application file for complete search history.

(56) References Cited

U.S. PATENT DOCUMENTS 6,198,890 B1 * 3/2001 Liu et al. ..... 399/224
6,487,376 B1 * 11/2002 Wang et al.
6,507,720 B2 * 1/2003 Kabumoto et al. ..... 399/258
6,757,512 B2 * 6/2004 Miyawaki et al. ..... 399/299
6,775,503 B2 * 8/2004 Hattori et al. ..... 399/258
6,799,011 B2 * 9/2004 Abe et al. ..... 399/299
6,819,897 B2 * 11/2004 Kita ..... 399/223
6,882,817 B2 * 4/2005 Kita ..... 399/258
6,947,690 B2 * 9/2005 Tazawa et al. ..... 399/258
7,257,349 B2 * 8/2007 Kitozaki ..... 399/258
2003/0147678 A1 * 8/2003 Ozawa et al.
2003/0235430 A1 * 12/2003 Koshida
2003/0235440 A1 * 12/2003 Takada
2004/0052538 A1 * 3/2004 Yugeta et al. ..... 399/258
2005/0036810 A1 * 2/2005 Murakami et al. ..... 399/360
2005/0117936 A1 * 6/2005 Takami ..... 399/258
2005/0281581 A1 12/2005 Kitozaki ..... 399/111

FOREIGN PATENT DOCUMENTS

JP 2001-265088 A 9/2001
JP 2002-148897 A 5/2002

* cited by examiner

*Primary Examiner*—David M Gray
*Assistant Examiner*—Laura K Roth
(74) *Attorney, Agent, or Firm*—Fitzpatrick, Cella, Harper & Scinto

(57) ABSTRACT

An image forming apparatus includes a specific color image forming station for forming a black image and one or more non-specific color image forming stations for forming images of colors other than black, the photosensitive drum of the specific color image forming station is located vertically downward of the photosensitive drums of the non-specific color image forming stations, and the capacity of the black toner cartridge of the specific color image forming station is made larger than those of the toner cartridges of the non-specific color image forming stations. With this arrangement, the frequency of replacement of the black toner cartridge can be reduced without adversely affecting the size of an apparatus main body.

6 Claims, 15 Drawing Sheets

IMAGE FORMING APPARATUS COMPRISING A PLURALITY OF IMAGE FORMING STATIONS AND PLURALITY OF DEVELOPER ACCOMMODATING VESSELS

BACKGROUND OF THE INVENTION

1. Field of the Invention

The present invention relates to an image forming apparatus such as a copying machine, a printer, and the like for forming an image on a recording material making use of an electrophotographic type process.

2. Description of the Related Art

At present, there are widely used electrophotographic image forming apparatuses having process cartridges, in which photosensitive drums, development units, and the like are arranged integrally with each other and which are detachably attachable thereon in order to execute maintenance and to replenish developers (hereinafter, referred to as "toner") easily. Since this type of the process cartridge must contain the amounts of toner corresponding to the durable life of the photosensitive drums determined by the deterioration thereof, there is a tendency for the sizes of the process cartridges to increase in their entirety.

Further, the amount of consumption of toner is greatly different depending on the density of an image created by a user. Accordingly, the process cartridge must be replaced when the photosensitive drum is deteriorated to a certain degree and when the toner is consumed in a predetermined amount. Actually, however, since the process cartridge is replaced early regardless of the fact that the photosensitive drum can be still used or toner still remains, there is a tendency that the running cost increases.

To cope with the above problem, recently, an image forming apparatus has been in practical use in which process cartridges are separated from toner cartridges for supplying toner to development units in the process cartridges and the respective cartridges can be independently attachable.

For example, as shown in FIG. 15, four process cartridges 200 for forming yellow, magenta, cyan, and black images and four toner cartridges 201 for supplying toner to the process cartridges 200 are mounted on an apparatus main body 202. Then, the toner images formed on photosensitive drums 200*a* in the process cartridges 200 are primarily transferred onto an intermediate transfer belt 203 sequentially. Further, the primarily transferred images are transferred onto a transfer material transported from a sheet cassette 204 by a transport roller 205 and rollers 214 in a secondary transfer section 206. After the transfer material is transported to a fixing unit 207 and the toner images are heated and fixed, it is discharged by rollers 216 to a discharge section 208 located to an upper portion of the apparatus (refer to Japanese Patent Application Laid-Open Publication No. 2002-148897).

When the toner cartridge is separated from the process cartridge, the respective cartridges can be replaced as they are consumed according to the durability thereof, thereby reducing the running cost of the cartridges.

Further, when a user, who conventionally uses a monochrome image forming apparatus, replaces it with a color image forming apparatus, the user does not always form a color image, and a monochrome image forming frequency may be higher than a color image forming frequency.

Accordingly, an image forming apparatus has been in practical use in which the frequency of replacing a black toner cartridge is reduced by setting the capacity of the black toner cartridge larger than that of the toner cartridges other than the black toner cartridge (refer to Japanese Patent Application Laid-Open Publication No. 2001-265088).

However, when the capacity of a particular toner cartridge is increased, a portion of the toner cartridge protrudes. When the spaces of the other toner cartridges are also increased to cover the protruded portion of the specific toner cartridge, a problem arises in that the size of an apparatus main body is increased.

An object of the present invention, which was made in view of the above problems, is to provide an image forming apparatus which has toner cartridges and process cartridges separately mounted thereon and can reduce the frequency of replacement of the toner cartridge used in a particular color image forming station without adversely affecting the size of an apparatus main body.

SUMMARY OF THE INVENTION

To solve the above problems, a typical means of the present invention includes a plurality of image forming stations each including at least an image bearing member for bearing an electrostatic image, a development means for developing the electrostatic image on the image bearing member with a developer, and a transfer means for transferring the developer image developed by the development means onto a transfer medium in a transfer section, wherein the transfer sections are disposed at different positions in a horizontal direction and at least one of the transfer sections is located at a different position in a vertical direction with respect to the positions of the other transfer sections, and a plurality of developer accommodation vessels disposed in correspondence to the plurality of image forming stations to accommodate replenishing developers, wherein the capacity of the developer accommodation vessel corresponding to the image forming station whose transfer section is located at a vertically lowest position is larger than those of the developer accommodation vessels of the image forming stations whose transfer sections are disposed vertically above of the transfer section located at the vertically lowest position.

Since the present invention is arranged as described above, even if the capacity of the developer accommodation vessel, which corresponds to the image forming station whose transfer section is located at the vertically lowest position, is made larger than those of the other developer accommodation vessels, an adverse affect on the height of an apparatus main body can be suppressed.

Accordingly, when black toner is accommodated in the developer accommodation vessel corresponding to the image forming station whose transfer section is located at the vertically lowest position, the frequency of replacement of the developer accommodation vessels can be reduced when a black monochrome image, which ordinarily has highest image forming frequency, is formed. Further, the running cost can be reduced when the black monochrome image is formed because the cost of the developer accommodation vessel per unit weight of the developer can be reduced.

DESCRIPTION OF PREFERRED EMBODIMENTS

Next, image forming apparatuses according to embodiments of the present invention will be described with reference to the drawings.

First Embodiment

Overall Arrangement of Image Forming Apparatus

First, the overall arrangement of the image forming apparatus of a first embodiment will be explained using FIG. 1. The image forming apparatus of the first embodiment is a so-called in line-type image forming apparatus as an electrophotographic type image forming apparatus for forming an image of a plurality of color or full colors. The image forming apparatus has a plurality of photosensitive drums disposed in a single row according to respective colors and forms a color image by sequentially overlapping the toner images of respective colors formed on the photosensitive drums on an intermediate transfer belt.

Figure 1:
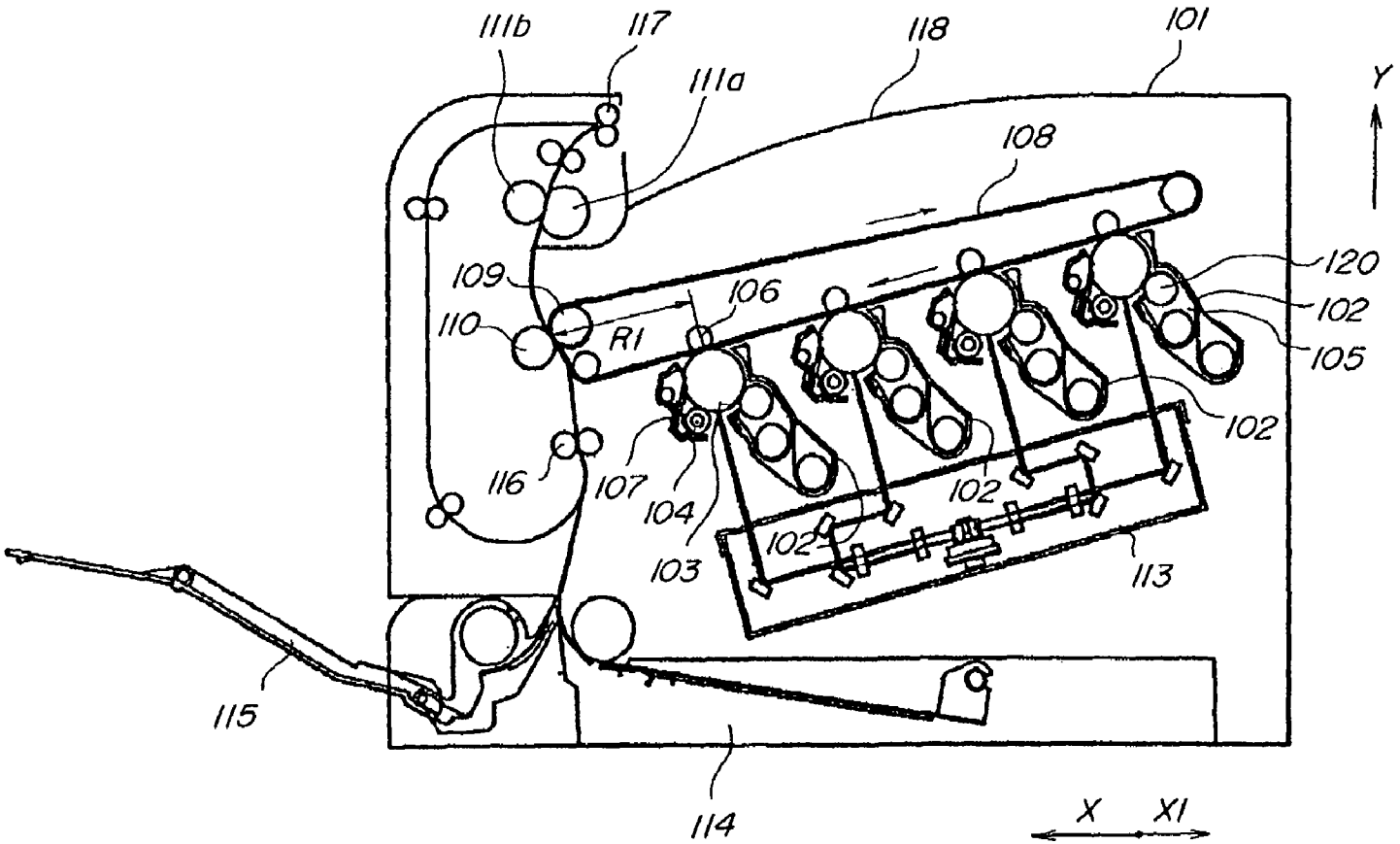
FIG. 1 is a schematic sectional view illustrating an image forming apparatus.

FIG. 1 is a schematic sectional view illustrating the image forming apparatus. In the image forming apparatus 101, a plurality of image forming stations are composed of process cartridges 102 disposed linearly at predetermined intervals and transfer rollers 106 as transfer means and disposed in confrontation with the process cartridges 102. Then, the image forming apparatus 101 is provided with four toner cartridges 100, which act as developer accommodation vessels corresponding to the image forming stations and supply toner. The image forming stations sequentially form yellow, magenta, cyan, and black color images from the right side in FIG. 1.

The process cartridges 102 include drum-type electrophotographic photosensitive members (hereinafter, referred to as "photosensitive drum") 103 as image bearing members disposed therein. Each of the photosensitive drums 103 includes a primary charger 104 as a primary charge means, a development means 105, a transfer roller 106 as primary transfer means, and a drum cleaner 107 disposed therearound, and a laser exposure unit 113 as an exposure means is disposed below the primary charger 104 and the development means 105 is disposed therebetween.

The photosensitive drum 103 is composed of a negative-charged OPC photosensitive member, has a photoconductive layer on an aluminum drum base member, and is driven in rotation by a drive unit (not shown) at a predetermined process speed.

The primary charger 104 as the primary charge means uniformly charges the surface of the photosensitive drum 103 to a predetermined negative potential by a charge bias applied from a charge bias power supply (not shown).

The development means 105 contain toner, deposit toner of respective colors on electrostatic latent images formed on the photosensitive drums 103, and develop the toner as toner images (make the toner into visible images).

The transfer rollers 106 as the primary transfer means are disposed in an intermediate transfer belt unit so as to confront the photosensitive drums 103 to thereby form transfer sections.

The drum cleaner 107 includes a cleaning blade and the like for removing the toner remaining on the photosensitive drum 103 in a primary transfer operation therefrom.

Note that, in the process cartridge 102 of the embodiment, the primary charger 104, the development means 105, and the drum cleaner 107 are arranged integrally with each other as a cartridge which can be detachably attachable to an apparatus main body.

The intermediate transfer belt unit having the intermediate transfer belt 108 is disposed above the process cartridges 102. The intermediate transfer belt unit includes the intermediate transfer belt 108 as a rotatable belt member, a drive roller 109 also acting as a secondary transfer confronting roller, and a gear disposed on an unillustrated drive roller axis, and the intermediate transfer belt 108 is driven in rotation by an unillustrated drive gear disposed on the apparatus main body. The drive roller 109 is disposed in confrontation with a secondary transfer roller 110.

As described above, since the intermediate transfer belt 108, onto which an image is primarily transferred, is disposed above the process cartridges 102, the moving distance R1 of the image, which has been transferred from the final photosensitive drum 103 in the plurality of process cartridges 102 onto the intermediate transfer belt 108 rotating in the direction of an arrow in FIG. 1, is reduced, thereby reducing a first print time.

Further, a fixing unit, which has a fixing roller 111*a* and a pressure roller 111*b* and is arranged as a vertical path and disposed downstream of the secondary transfer roller 110 in the direction in which a transfer material is transported.

The exposure unit 113 is composed of a laser emission means for emitting a laser beam corresponding to the time series electric digital pixel signals of given image information, a polygon mirror, a refection mirror, and the like and exposes the photosensitive drums 103 to thereby form electrostatic latent images of respective colors according to the image information on the surfaces of the photosensitive drums 103 charged by the primary chargers 104.

Then, the toner of the electrostatic latent images formed on the photosensitive drums 103 is developed by the development means 105 and made into visible images, and color images are formed by primarily transferring the visible images onto the intermediate transfer belt 108 sequentially. In synchronism with the image formation, a transfer material as a transfer medium is transported from a sheet cassette 114 or a manual sheet feed tray 115 to a secondary transfer section by a transportation roller 116, and the toner images on the intermediate transfer belt 108 are secondarily transferred onto the transfer material by applying a bias to the secondary transfer roller 110. After the toner images on the transfer material are heated and fixed by the fixing unit 111*a* and 111*b*, the transfer material is discharged to a discharge section 118 on the surface of the apparatus by discharge rollers 117.

Note that, as described later, toner is replenished from the toner cartridges 100, which are separated from the process cartridges 102, to the development means 105 of the process cartridges 102.

[How Process Cartridges and Toner Cartridges are Disposed]

Figure 2:
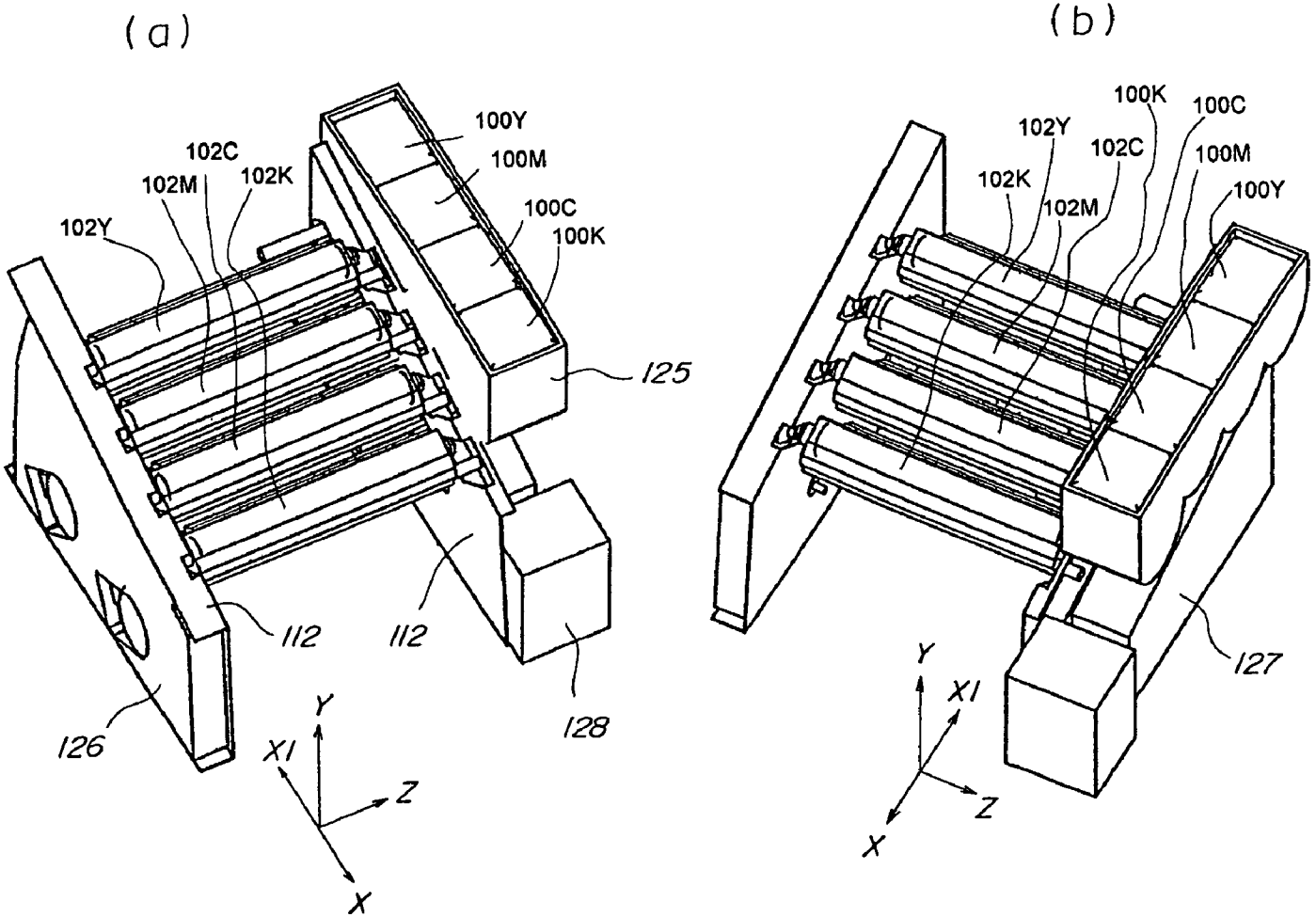
FIGS. 2A and 2B are perspective views illustrating the image forming apparatus when it is viewed from a front side.
Figure 3:
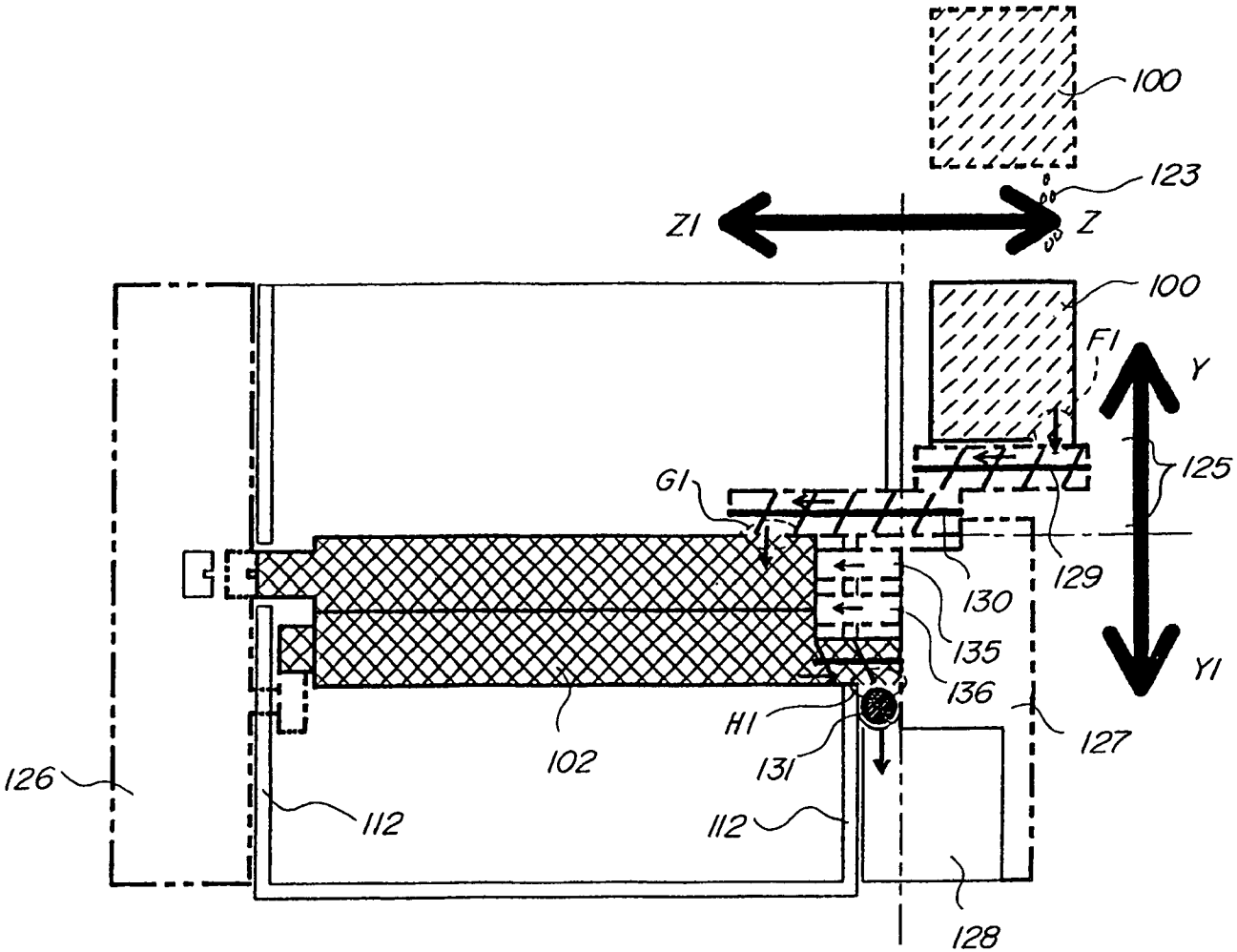
FIG. 3 is a schematic view illustrating how the image forming apparatus is disposed when it is viewed from a front side (the direction of an arrow X1 in FIGS. 2A and 2B)
Figure 4:
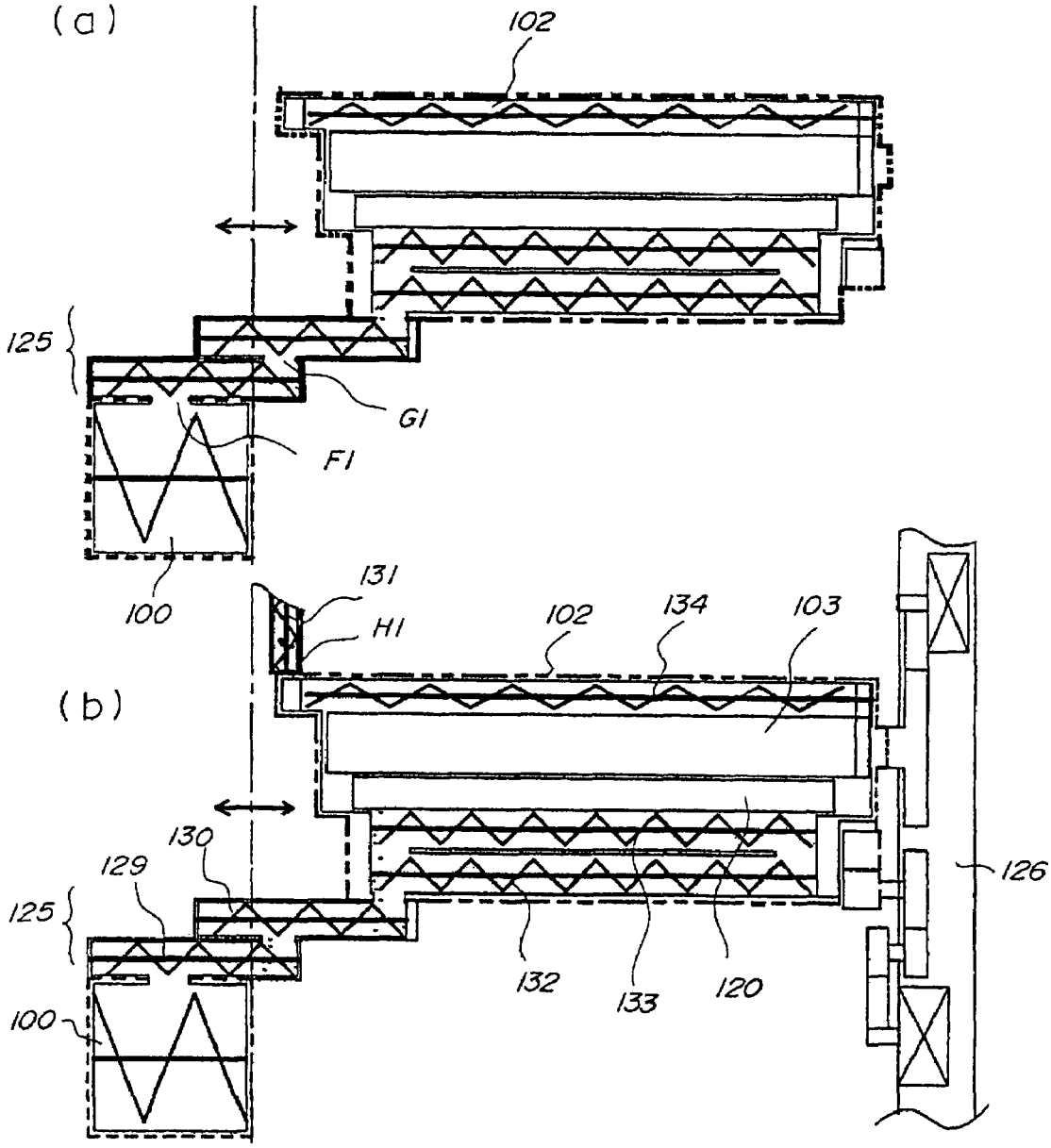
FIGS. 4A and 4B are sectional views illustrating the image forming apparatus when it is viewed from above it (the direction of an arrow Y1 in FIG. 3)

How the process cartridges 102 and the toner cartridges 100 of the embodiment are disposed and how toner circulates will be explained with reference to FIGS. 2A to 7. FIGS. 2A and 2B are perspective views explaining the image forming apparatus when it is viewed from a front side. In the figures, the directions of arrows X-X1 are the front and back directions of the apparatus, the direction of an arrow Y is the height direction thereof, and the direction of an arrow Z is the left to right direction of the apparatus. Further, FIG. 3 is a view illustrating how the image forming apparatus is disposed when it is viewed from a front side (the direction of the arrow X1 in FIG. 2), FIGS. 4A and 4B are sectional views illustrating the image forming apparatus when it is viewed from above it (in the direction of an arrow Y1 in FIG. 3). (The main body is not driven in FIG. 4A and is driven in FIG. 4B.)

As shown in FIG. 2, the process cartridges 102 of the embodiment are supported in and detachably mounted on a main body frame 112. Further, the toner cartridges 100 for supplying toner to the development means 105 of the process cartridges 102 are separated from the process cartridges 102 and mounted on the mounting section of a toner replenish/transport means 125 disposed to the outside of the main body frame 112.

More specifically, the process cartridges 102 and the toner cartridges 100 being mounted are disposed such that they do not overlap in the rotation axis direction of the photosensitive drums 103 and the toner cartridges 100 are mounted on the apparatus main body at positions higher than the process cartridges 102.

Reference numeral 126 denotes a drive unit (drove means) for driving the process cartridges 102, and a high voltage power supply 127 is disposed below the toner replenish/transport means 125 and a waste toner collection box 128 is disposed in front of the apparatus main body (the X-direction) on the side of the main body frame 112 in the Z-direction confronting the drive unit 126, respectively. The high voltage power supply 127 supplies a high voltage when an image is formed, and the waste toner collection box 128 collects waste toner discharged from the process cartridges 102 so that it is replaced.

With the above arrangement, it is possible to dispose a drum gear and the like, which receive a drive force from the drive unit 126, on one side of the process cartridges 102 in the lengthwise direction thereof and to dispose the contacts of a development bias input, a charge input, and the like, which are connected to the high voltage power supply 127, on the other side thereof.

As shown in FIG. 3, toner replenished from the toner cartridges 100 at sections F1 passes through the first transport screw 129 and the second transport screw 130 of the toner replenish/transport means 125 and is quantitatively supplied into the process cartridges 102 at sections G1 located below the screws 129 and 130. Then, the toner, which is stirred and transported by first stirring screws 132 and second stirring screws 133 in the process cartridges 102 shown in FIG. 4, is coated on the photosensitive drums 103 by development screws and attracted thereto.

The toner remaining on the photosensitive drums 103 without being primarily transferred (hereinafter, referred to as "waste toner") is collected by the drum cleaners 107 (refer to FIG. 1), and the waste toner transported by a waste toner transport means 134 is discharged from the process cartridges 102 at sections H1. The discharged waste toner is supplied to a waste toner transport unit 131 as a toner discharge/transport means, which transports the waste toner by rotating a transport screw, and is further supplied to the waste toner collection box 128 shown in FIG. 3.

Figure 5:
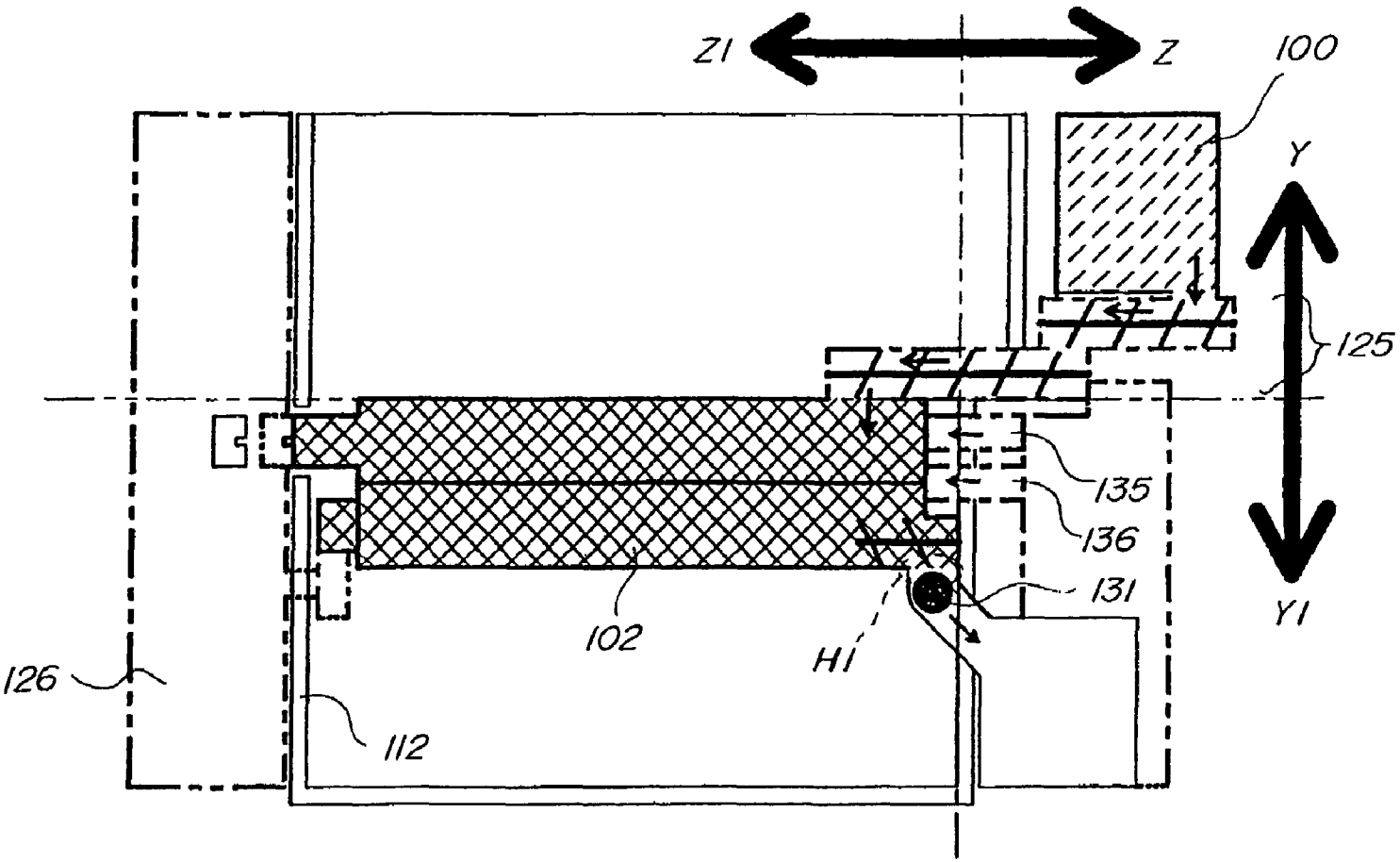
FIG. 5 is a view illustrating how toner is transported when the image forming apparatus is viewed from the front side of it.

Note that, in the arrangement shown in FIG. 3, the waste toner transport unit 131 is disposed externally of the main body frame 112. However, even if the waste toner transport unit 131 is disposed internally of the main body frame 112 as shown in FIG. 5, toner is circulated similarly to the above arrangement. With this arrangement, the drive unit 126 can be disposed in confrontation with a toner circulation path in the main body frame 112, thereby preventing the drive force transmission accuracy of the drive gear and the like from deteriorating by scattered toner.

Figure 6:
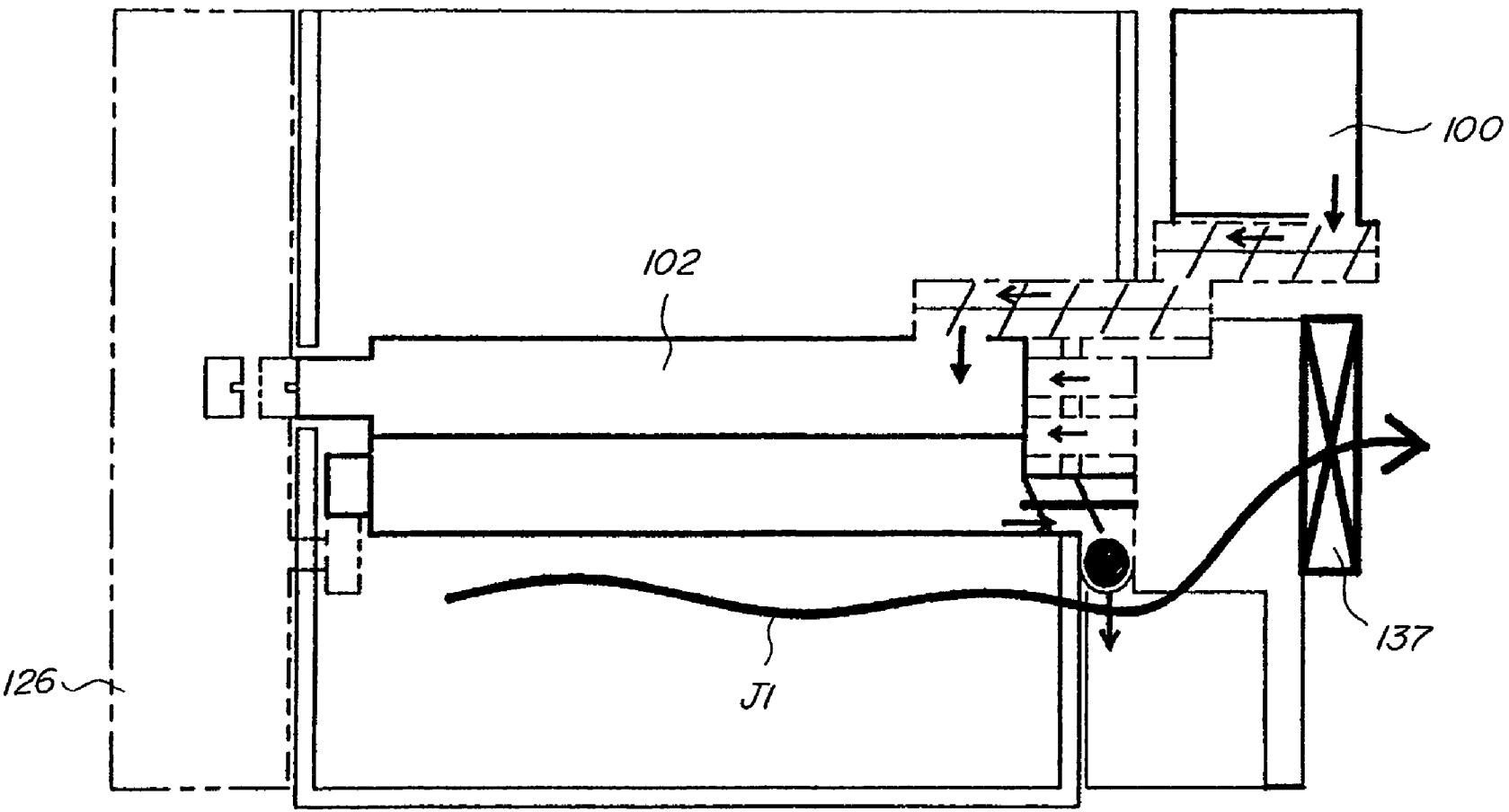
FIG. 6 is a view illustrating an air flow when the image forming apparatus is viewed from the front side of it.

Further, as shown in FIG. 6, a cooling fan 137 is disposed to generate an air flow J1 from the drive unit 126 to the toner circulation path to prevent an increase of the temperature in the main body frame 112 of the image forming apparatus, thereby obtaining a greater effect of preventing the accuracy of the drive gear and the like from deteriorating by toner scattering.

Note that the waste toner transport means 134 of the embodiment (refer to FIG. 4) straddles the process cartridges 102 in the front to back direction of the apparatus (in the directions of arrows X-X1 in FIG. 7) as well as is disposed below the toner cartridges 100. The waste toner is delivered from the process cartridges 102 to the waste toner transport unit 131 in sections H1, and the waste toner in the waste toner transport unit 131 is accommodated in the toner collection box 128.

Further, the high voltages such as the development bias, the charge current, and the like are directly input from the high voltage power supply 127 shown in FIG. 3 to the process cartridges 102 through a development bias input contact 135 and a charge input contact 136 of the process cartridges 102. With this arrangement, a cable from the high voltage power supply is omitted, thereby reducing the cost and employing a countermeasure for leakage.

[How Process Cartridges are Disposed and Capacities of Toner Cartridges]

Next, how the process cartridges 102 are disposed and the capacities of the toner cartridges 100 will be explained with reference to FIGS. 7 and 8. Note that FIG. 7 is a view illustrating the apparatus main body when it is viewed from a lateral side thereof (in the direction of an arrow Z1 in FIG. 5), and FIG. 8 is a partial view illustrating the toner cartridges being mounted when they are viewed from above them (in the direction of an arrow Y1 in FIG. 7).

Figure 7:
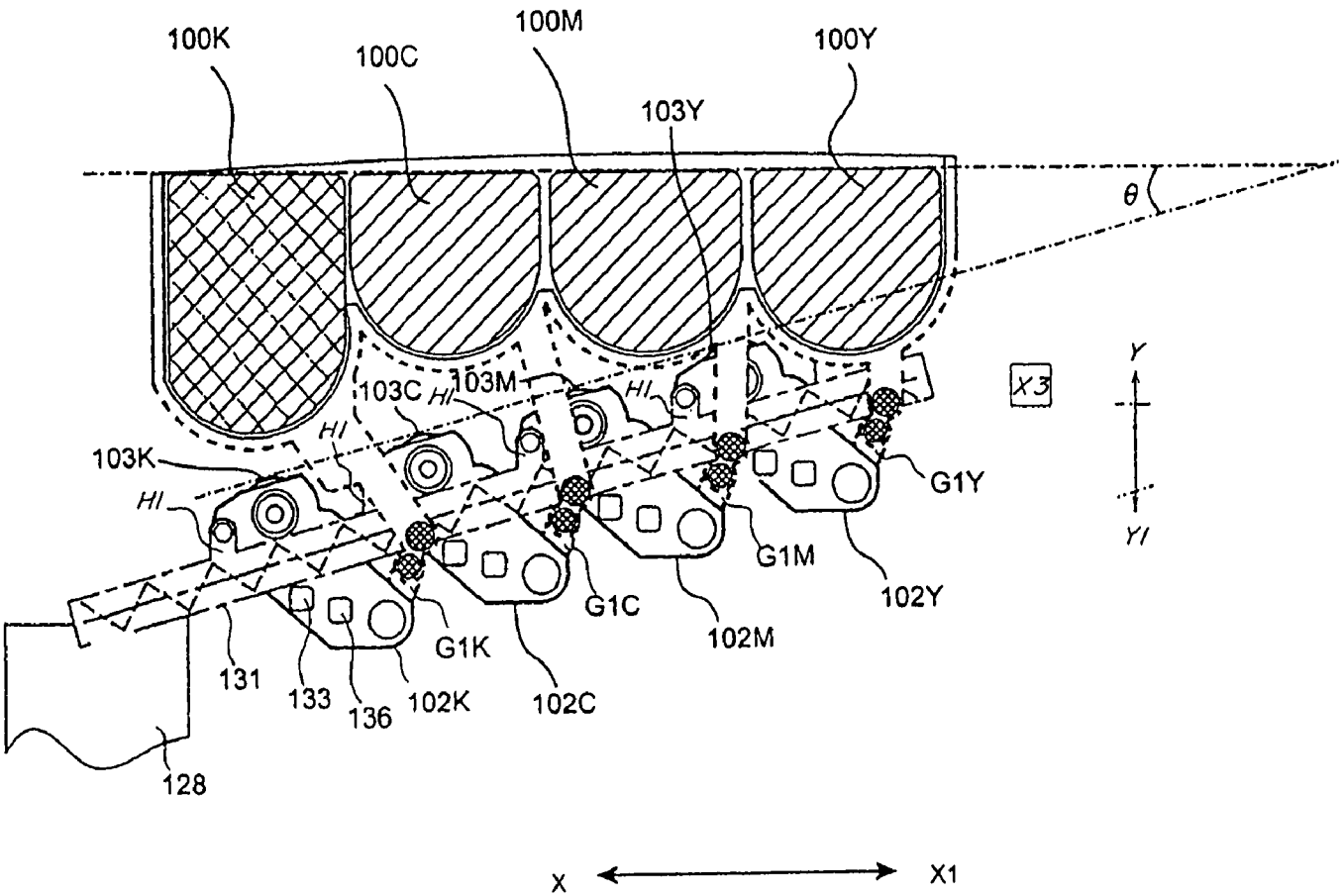
FIG. 7 is a view illustrating an apparatus main body when it is viewed from a lateral side thereof (the direction of an arrow Z1 in FIG. 5)
Figure 8:
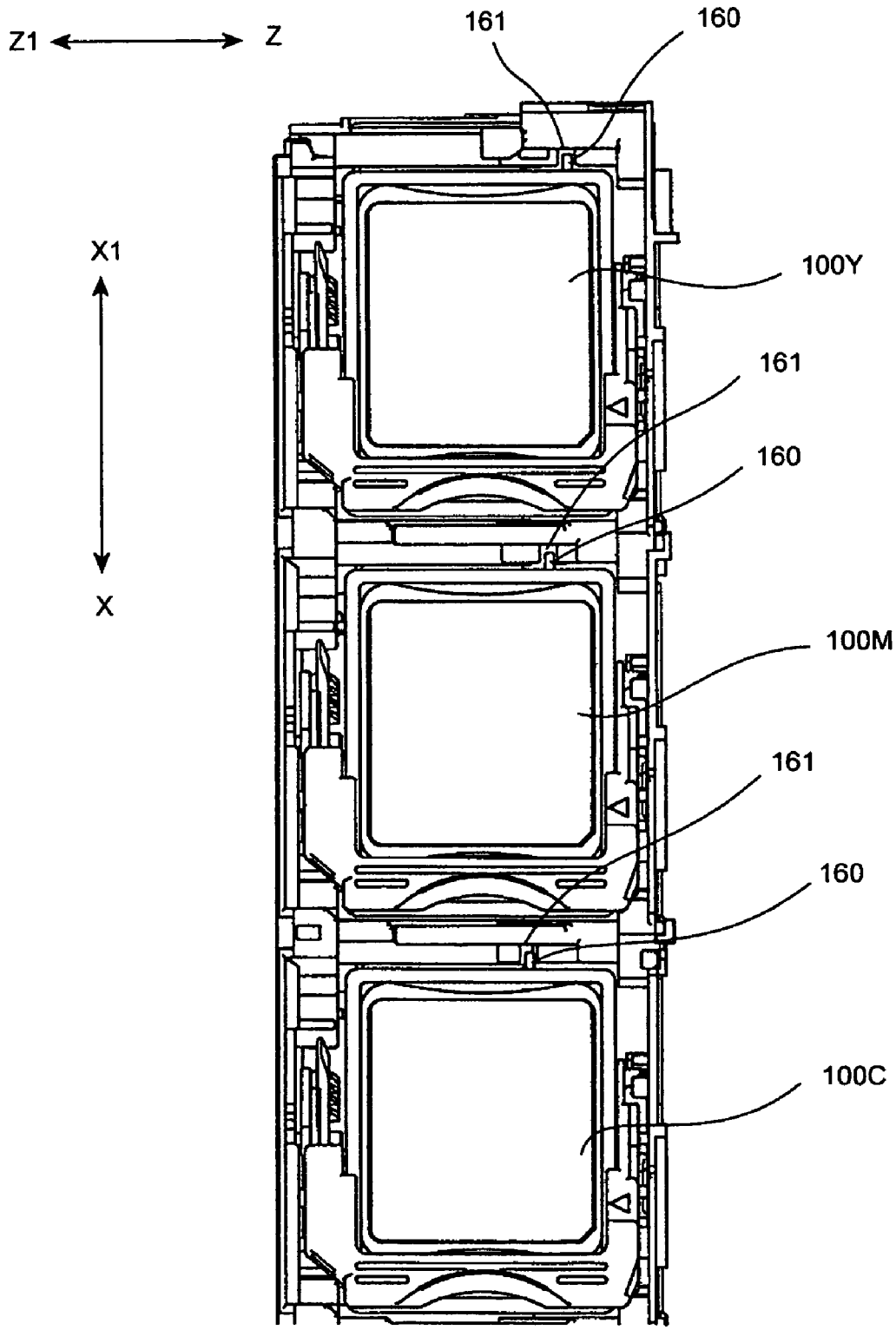
FIG. 8 is a partial view illustrating cartridges being mounted when they are viewed from above them.

In the image forming apparatus of the embodiment, a mounting section, on which the plurality of (four) process cartridges 102 are mounted, inclines downward toward the front side of the main body (in the direction of the arrow X) in the front and back directions of the apparatus (in the directions of arrows X-X1 in FIG. 7). That is, the process cartridges 102 being mounted are disposed such that the heights thereof are sequentially different from each other.

Then, the process cartridges 102 are arranged such that they are disposed sequentially lower from the back side of the apparatus (in the direction of the arrow X1) toward the front side thereof (in the direction of the arrow X). Then, a yellow image forming station, a magenta image forming station, a cyan image forming station, and a black image forming station are sequentially disposed from the back side of the apparatus toward the front side thereof.

A process cartridge 102Y, which forms a yellow image, and a yellow toner cartridge 100Y, in which yellow toner is accommodated, are mounted on the yellow image forming station. Likewise, a process cartridge 102M, which forms a magenta image, and a magenta toner cartridge 100M, in which magenta toner is accommodated, are mounted on the magenta image forming station. A process cartridge 102C, which forms a cyan image, and a cyan toner cartridge 100C, in which cyan toner is accommodated, are mounted on the cyan image forming station. A process cartridge 102K, which forms a black image, and a black toner cartridge 100K, in which black toner is accommodated, are mounted on the black image forming station.

Although a color image is formed by overlapping toner images having the four colors and transferring the toner images onto the intermediate transfer belt, a monochrome image is formed of only the black toner and the other three colors are not used. Accordingly, the black toner is used most frequently of the toner of the four colors. Accordingly, in the embodiment, black is designated as a specific color, and yellow, magenta, and cyan other than the black are designated as non-specific colors.

As a result, the specific color image forming station in the embodiment is the black image forming station, and the non-specific color image forming stations are the yellow, magenta, and cyan image forming stations. Further, the specific color toner cartridge is the black toner cartridge 100K and the non-specific color toner cartridges are the yellow, magenta, and cyan toner cartridges 10Y, 100M, and 100C.

Then, in the image forming apparatus of the embodiment, when the process cartridges 102 (102Y, 102M, 102C, and 102K) are mounted, a photosensitive drum 103*k* of the black image forming station is disposed vertically below respective photosensitive drums 103Y, 103M, and 103C of the yellow, magenta, and cyan image forming stations.

Accordingly, as shown in FIG. 7, the black image forming station has the largest height direction space from the upper surface of the apparatus to the process cartridges 102 (102Y, 102M, 102C, and 102K). Thus, in the embodiment, the vertical length (height) of the black toner cartridge 100K is set longer than those of the other toner cartridges 100Y, 100M, and 100C. Note that the vertical lengths of the non-specific color toner cartridges 100Y, 100M, and 100C are set to the same length.

Further, as shown in FIG. 8, the four toner cartridges 100 (100Y, 100M, 100C, and 100K) have the same size in the front to back direction of the apparatus (in the directions of arrows X-X1) and in the right to left direction thereof (in the directions of arrows Z-Z1). As a result, the size of the black toner cartridge 100K in the height direction (the cartridge shown by an oblique grid shape in FIG. 7) is larger than those of the other three toner cartridges 100Y, 100M, and 100C, thereby setting the toner capacity of the black toner cartridge 100K to be larger than those of the other three toner cartridges 100Y, 100M, and 100C.

Even if the size of the black toner cartridge 100K in the height direction is set larger than those of the other toner cartridges 100Y, 100M, and 100C, the toner supply position from the black toner cartridge 100K to the process cartridge 102K can be lowered. That is, as shown in FIG. 7, a toner supply position (receiving port for receiving toner) G1K at which toner is supplied from the black toner cartridge 100K to the process cartridge 102K corresponding thereto is located at a position vertically lower than toner supply positions G1Y, G1M, and G1C at which toner is supplied from the other toner cartridges 100Y, 100M, and 100C to the process cartridges 102 corresponding thereto.

Accordingly, even if the capacity of the black toner cartridge 100K is increased, it is possible to supply the toner in the black toner cartridge 100K to the process cartridge 102K located vertically downward by dropping it thereto.

As described above, it is possible to reduce the toner cartridge replacement frequency of the user as well as to reduce the running cost of the toner cartridges by making the capacity of the black toner cartridge 100K having higher print out frequency larger than those of the other toner cartridges 100Y, 100M, and 100C.

Even if the capacity of the black toner cartridge 100K is made larger than those of the other toner cartridges 100Y, 100M, and 100C, the four toner cartridges 100 (100Y, 100M, 100C, and 100K) being mounted have approximately the same upper ends. Accordingly, the upper surfaces of the toner cartridges 100 can be made flat easily.

As described above, in the image forming apparatus of the embodiment, the four image forming stations are disposed such that the vertical heights thereof are sequentially reduced. In accordance with the above arrangement, the surface of the intermediate transfer belt 108 abutted against the photosensitive drums 103 (103Y, 103M, 103C, and 103K) has a predetermined inclination angle θ with respect to a horizontal direction. In the image forming apparatus of the embodiment, the inclination angle is set to $\theta=15°$. It is possible to reduce the region, in which the process cartridges 102 and the toner cartridges 100 are mounted upward and downward, by obliquely disposing the plurality of the image forming stations.

This will be explained with reference to FIG. 7. In the embodiment, the toner cartridge 100C of the cyan image forming station, which is disposed adjacent to the black image forming station, occupies a part of the upper region of the process cartridge 102K of the black image forming station. Likewise, the toner cartridge 100M of the magenta image forming station, which is disposed adjacent to the cyan image forming station, occupies a part of the upper region of the process cartridge 102C of the cyan image forming station. Further, the toner cartridge 100C of the cyan image forming station, which is disposed adjacent to the magenta image forming station, occupies a part of the upper region of the process cartridge 102M of the magenta image forming station. Further, the toner cartridge 100M of the magenta image forming station, which is disposed adjacent to the yellow image forming station, occupies a part of the upper region of the process cartridge 102Y of the yellow image forming station.

As described above, since the toner cartridges of the adjacent image forming stations are disposed to link the upper regions of the respective process cartridges, the size of the image forming apparatus can be reduced in the front to back direction thereof (in the directions of the arrows X-X1 in FIG. 7).

Note that the inclination angle θ of the flat surface of the intermediate transfer belt 108 confronting the photosensitive drums 103 is set preferably to $5° \leqq \theta \leqq 80°$ and more preferably to $10° \leqq \theta \leqq 45°$. When the inclination angle θ is smaller than the above ranges, since the link regions of the process cartridges 102 and the toner cartridges 100 are reduced, the size of the apparatus is increased in the front to back direction thereof. In contrast, when the inclination angle θ is larger than the above ranges, the height of the image forming apparatus is increased.

As described above, the capacity of the black toner cartridge 100K as the specific color toner cartridge is larger than the capacities of the toner cartridges 100Y, 100M, and 100C as the other non-specific color toner cartridges. However, it is preferable that the three non-specific toner cartridges 100Y, 100M, and 100C have the same shape including the capacity thereof. When the toner cartridges 100Y, 100M, and 100C have the same shape, they can be manufactured in large quantities by the injection molding of resin using the same metal mold, thereby reducing the cost thereof.

Note that, as shown in FIG. 8, the three toner cartridges 100Y, 100M, and 100C of the embodiment are formed in the same shape except for key portions 160 disposed at different positions to prevent the cartridges from being mounted erroneously. The mounting portions of the apparatus main body, on which the toner cartridges 100Y, 100M, and 100C are mounted, have engagement portions 161 at the positions thereof corresponding to the positions of the key portions 160. The engagement portions 161 and the key portions 160 are located at different positions depending on the colors thereof so that the toner cartridges cannot be mounted on the cartridge mounting portions having colors different from the colors of these portions 161 and 160.

The black toner cartridge 100K is also provided with an erroneously mounting prevention key section 160 which is located at a position different from those of the non-specific color toner cartridges 100Y, 100M, and 100C With the above arrangement, any of the toner cartridges 100 is prevented from being erroneously mounted.

The non-specific color toner cartridges 100Y, 100M, and 100C of the embodiment are arranged similarly except for the erroneously mounting prevention key portions 160 located at the different positions. Accordingly, the toner cartridges 100Y, 100M, and 100C cannot be molded from resin using the same metal mold. However, when the metal mold is divided into sub metal molds so that the key portions 160 are formed in different shapes, a main sub metal mold can be commonly used, thereby reducing the cost of the toner cartridges 100Y, 100M, and 100C. As a result, even if the shapes of the non-specific color toner cartridges are not the same, when they are approximately the same, an effect of cost reduction can be obtained.

However, toner cartridges having the plurality of key portions corresponding to the respective colors of the non-specific color toner cartridges may be molded using a common metal mold, and then unnecessary key portions may be removed therefrom with a nipper and the like. With this arrangement, even the toner cartridges, in which the erroneously mounting prevention key portions are located at different positions, can be molded from resin using the same metal mold.

As described above, the non-specific color toner cartridges 100Y, 100M, and 100C of the embodiment have approximately the same shape (excluding the positions of the key portions). That is, as shown in FIGS. 2 and 8, the toner cartridges 100Y, 100M, and 100C have the same size in the right to left direction of the apparatus main body (in the direction of an arrow Z of FIG. 2), which is the rotation axial direction the photosensitive drums 103 of the non-specific color toner cartridges 100Y, 100M, and 100C. Further, not only the toner cartridges 100Y, 100M, and 100C but also the black toner cartridge 100K, acting as the specific color toner cartridge, have the same size in the rotation axial direction of the photosensitive drums 103.

With the above arrangement, when all the toner cartridges are mounted on the apparatus main body, no protruding portion is formed in the right to left direction of the apparatus main body (in the direction of the arrow Z of FIG. 2) which is the rotation axial direction of the photosensitive drums 103. As a result, a device for the transmission of a drive force to the toner cartridges, and the like can be easily designed.

[Input of Drive Force to Process Cartridge]

Subsequently, a method of inputting a drive force to the process cartridges 102 will be explained with reference to FIGS. 9A-9C. Note that FIG. 9A is a sectional explanatory view when the main body is viewed from above it, FIG. 9B is a sectional explanatory view illustrating how a drum gear moves, and FIG. 9C is a side elevational explanatory view around process cartridges.

Figure 9:
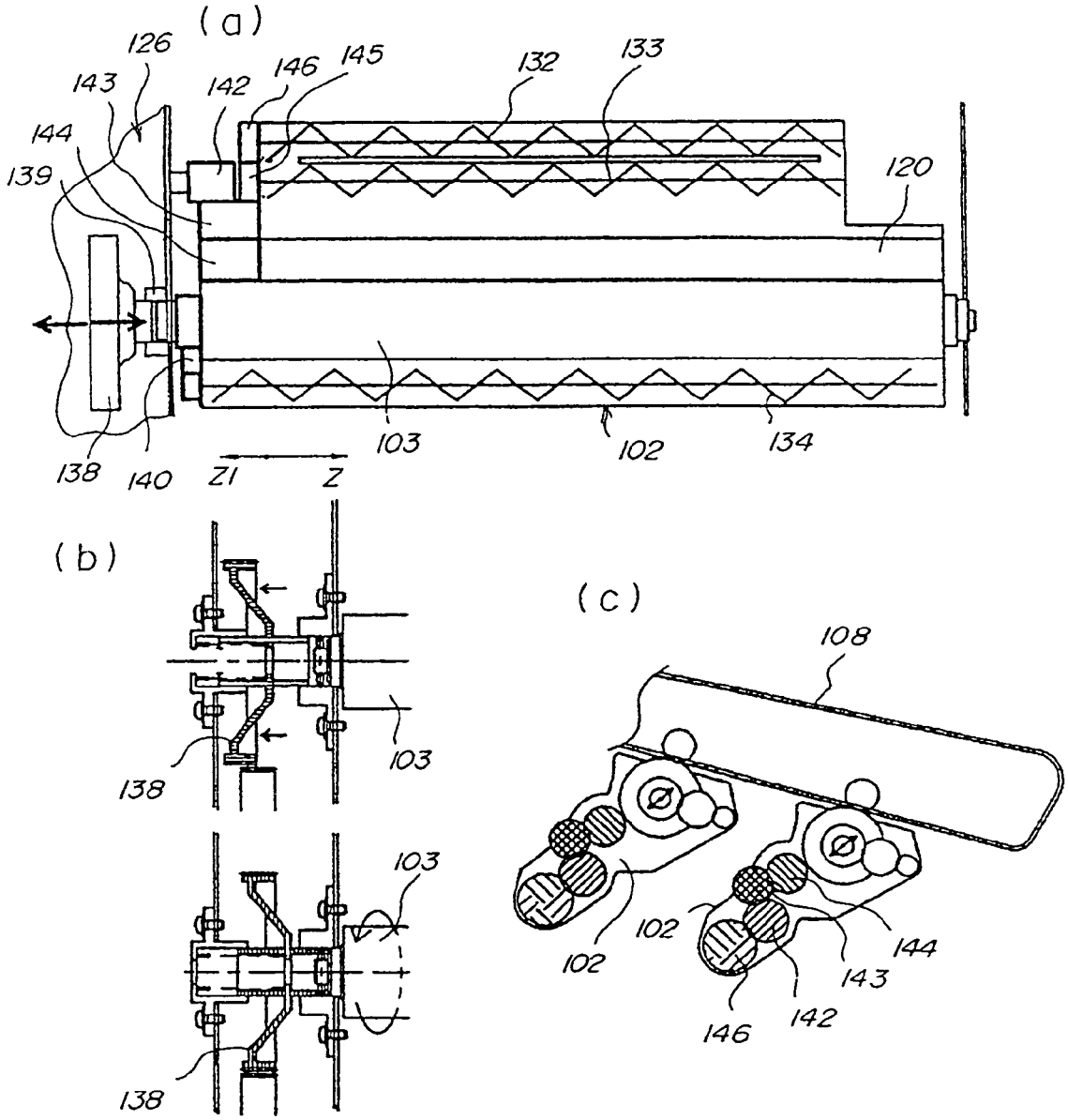
FIGS. 9A, 9B, and 9C are views illustrating how main body drive force is transmitted to process cartridges.

As shown in FIGS. 9A and 9B, a drum gear 138 in the drive unit 126, which transmits the drive force to the photosensitive drums 103, can move in the directions of arrows Z-Z1, and when a process cartridge is replaced, the drum gear 138 moves in the direction of the arrow Z, and when the main body is driven, the drum gear 138 moves in the direction of the arrow Z. Note that when cartridge replacement covers 121 and 122 are opened and closed, the drum gear 138 moves in the directions of the arrows Z-Z1 although it is not illustrated.

Then, the transmitted drive force is sequentially transmitted to a first drum gear 139, a second drum gear 140, and a third drum gear to thereby drive a waste toner transport means 134.

Next, a development drive force is transmitted from a development gear 142 of the drive unit 126 to a first development gear 143 and a second development gear 144 to thereby drive a development sleeve 120. Further, the development drive force is transmitted from the first development gear 143 to stirring gears 145 and 146 to thereby rotate the first stirring screw 132 and as the second stirring screw 133.

[Replacement of Cartridge]

Next, a method of replacing the process cartridges 102 and the toner cartridges 100 will be explained with reference to FIGS. 10A and 10B.

Figure 10:
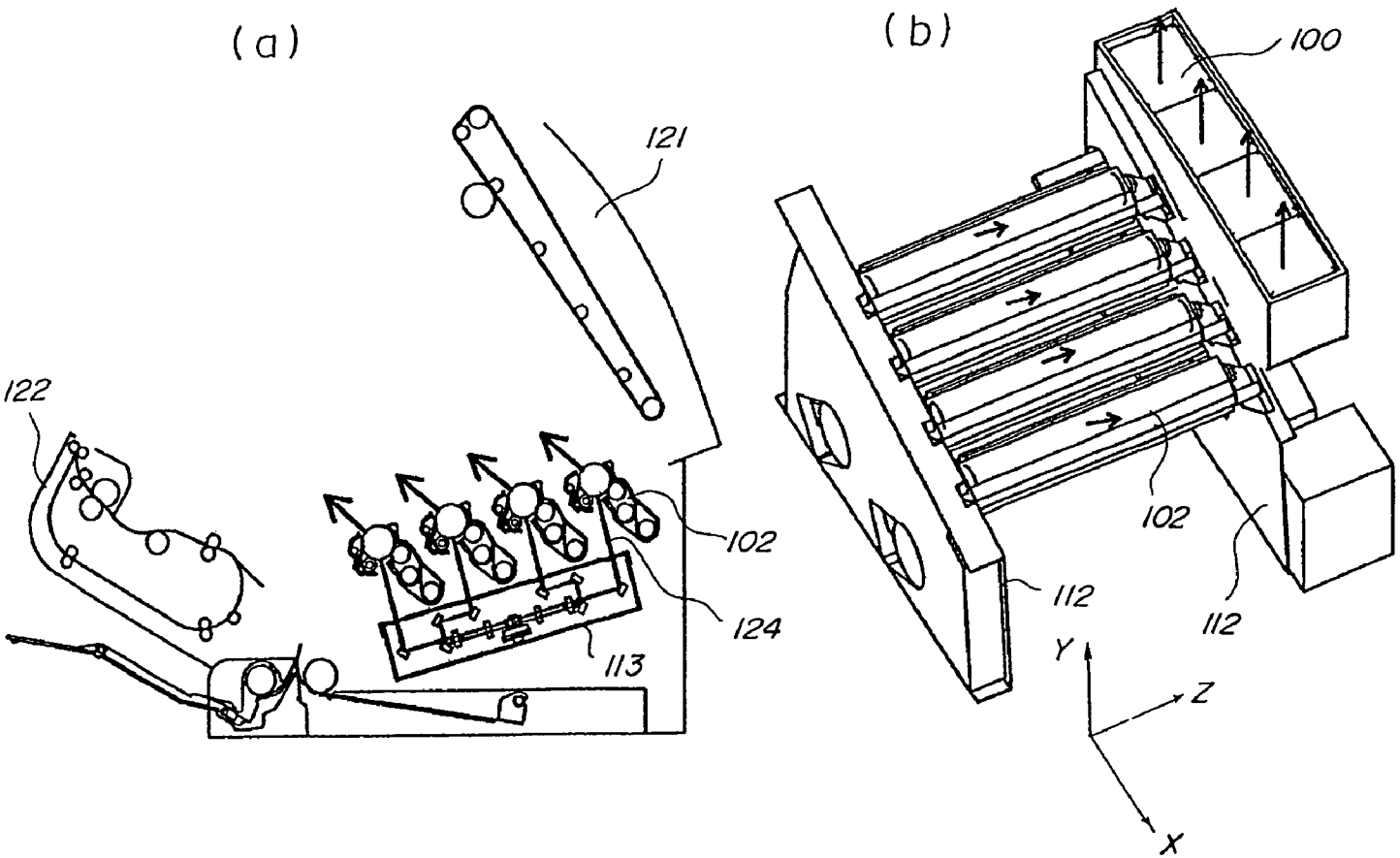
FIGS. 10A and 10B are views illustrating how the process cartridges and the toner cartridges are replaced.

As shown in FIGS. 10A and 10B, the toner cartridges 100 are disposed upward of the process cartridges 102 in an up/down direction (in the direction of an arrow Y) as well as at separate positions with respect to the process cartridges 102 in a right to left direction (in the direction of an arrow Z). Since the process cartridges 102 are separated from the toner cartridges 100 in the direction of the arrow Z (in the rotation axial direction of the photosensitive drums), the process cartridges 102 can be removed from the apparatus main body for replacement without removing the toner cartridges 100 after the cartridge replacement covers 121 and 122 are opened as shown in FIGS. 10A and 10B.

Accordingly, the process cartridge can be directly replaced, different from the conventional example in which a process cartridge must be replaced after a toner cartridge is removed. As a result, the replacing property of the process cartridge can be greatly improved.

Further, when the toner cartridges 100 are replaced, since they are separated from the process cartridges 102 in the rotation axial direction of the photosensitive drums (refer to FIGS. 3 and 4) and disposed externally of the main body frame 112 (in the direction of an arrow Z), the toner 123 dropped from the toner cartridges 100 does not drop onto the exposure unit 113 in the main body frame 112 even if the toner cartridges 100 are removed. With this arrangement, when the toner cartridges 100 are replaced, scattering of the toner into the apparatus can be prevented and a light path 124 can be prevented from being clogged with the toner dropped onto the exposure unit 113, thereby guaranteeing the quality of an image. Thus, it is possible to dispose the exposure unit 113 at a lower portion in the main body frame 112, thereby increasing the degree of freedom of design.

[Disposition of Electrical Equipment]

Figure 11:
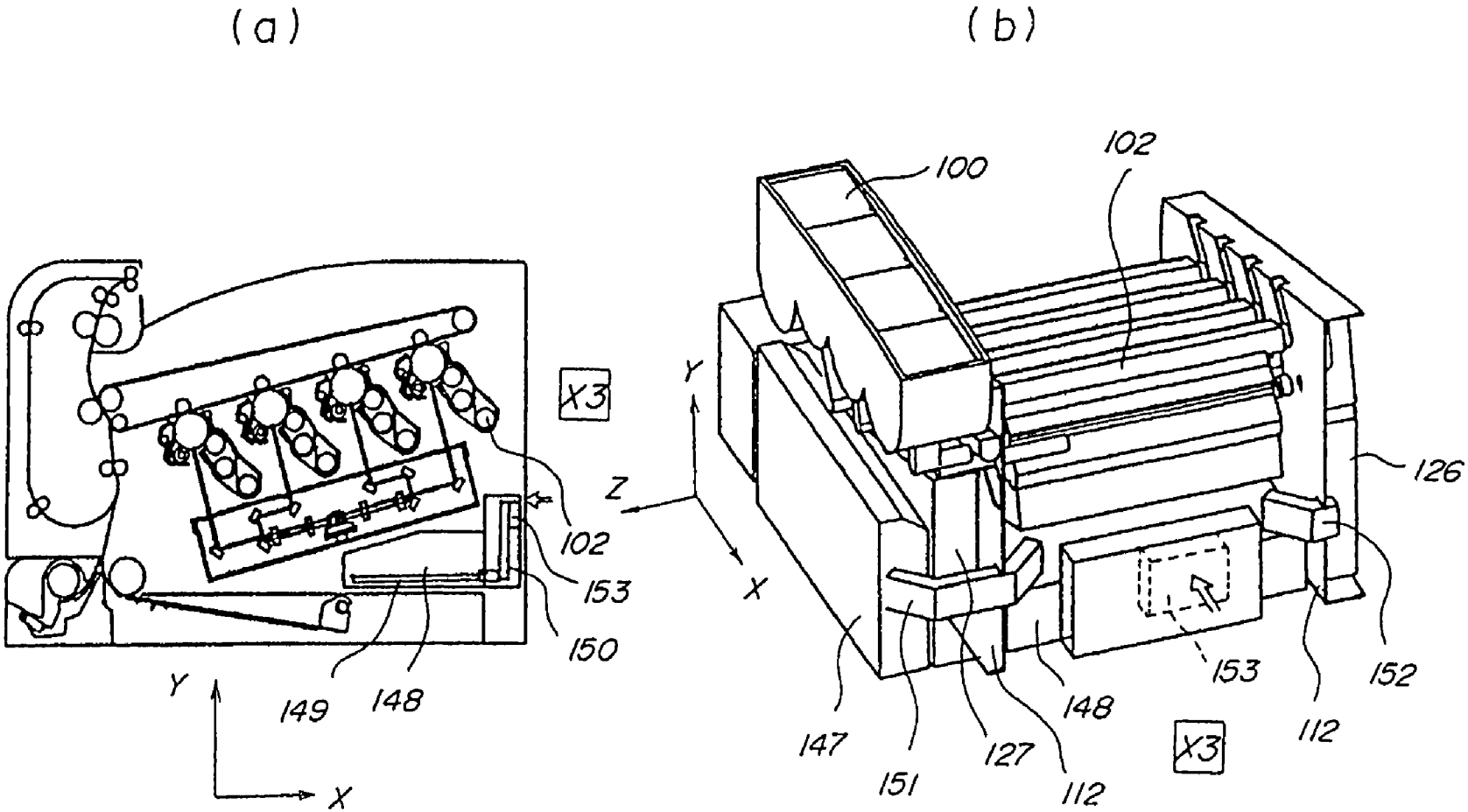
FIGS. 11A and 11B are views illustrating how electrical components are disposed in the image forming apparatus.

Next, how electrical equipment of the image forming apparatus is arranged and disposed will be explained with reference to FIGS. 11A and 11B. FIG. 11A is a sectional view showing the arrangement of the main body of the image forming apparatus, and FIG. 11B is a perspective view of the main body of the image forming apparatus when it is viewed from the back side thereof.

The high voltage power supply 127 is disposed to the main body frame 112 on the side thereof confronting the drive unit 126 so that the high voltages, such as the charge bias and the development bias, are directly input to the process cartridges 102 described above.

A main power unit 147 of 5-24 V is disposed to the outside of the main body of the high voltage power supply 127 (refer to FIG. 11B). Further, a DC controller 148 is disposed to the space of the main body frame 112, which is made vacant by obliquely disposing the process cartridges 102 to thereby execute turning ON and OFF of the drive motor, and the like (refer to FIG. 11B).

Likewise, a main body controller 150 is connected to the outside of the main body of the high voltage power supply 127 such that it is disposed backward of the main body of the DC controller 148 (on the X3 side in FIG. 11) and vertically with respect to the substrate 149 of the DC controller 148. The main body controller 150, the main power unit 147, the high voltage power supply 127, and the DC controller 148 are connected to each other through a first cable 151. Further, the DC controller 148 is connected to a motor, a clutch, a sensor, and the like of the drive unit 126 through a second cable 152. The first and second cables 151 and 152 are disposed to the back side of the main body.

Since the power supplies are arranged and disposed as described above, the drive unit 126, the main power unit 147, the DC controller 148 for controlling the high voltage power supply 127, and the main body controller 150 can be uniformly connected to the loads on both the sides of the main body frame 112 and further they can be disposed making use of the vacant space of the main body frame 112, thereby reducing the size of the main body. Further, since the main body controller 150 is disposed on the back side surface (the X3 side surface shown in FIGS. 11A and 11B) of the main body, a hard disc unit 153 can be optionally connected very easily in the main body controller 150 so that it can store an increased amount of data and increase the processing speed of print signals and the like.

Second Embodiment

Next, an image forming apparatus according to a second embodiment will be described with reference to FIG. 12. Note that since the basic arrangement of the image forming apparatus of the second embodiment is the same as that of the first embodiment described above, a duplicate description thereof is omitted, and only the arrangements characteristic to the second embodiment will be described. Further, the members of the second embodiment having the same functions as those of the first embodiment described above are denoted by the same reference numerals.

In the first embodiment described above, toner images formed on the photosensitive drums 103 are primarily transferred onto the intermediate transfer belt 108 and then secondarily transferred onto a transfer material. However, the present invention can be also applied to a so-called direct transfer-type image forming apparatus in which the toner images on photosensitive drums 103 are directly transferred onto a transfer material.

Figure 12:
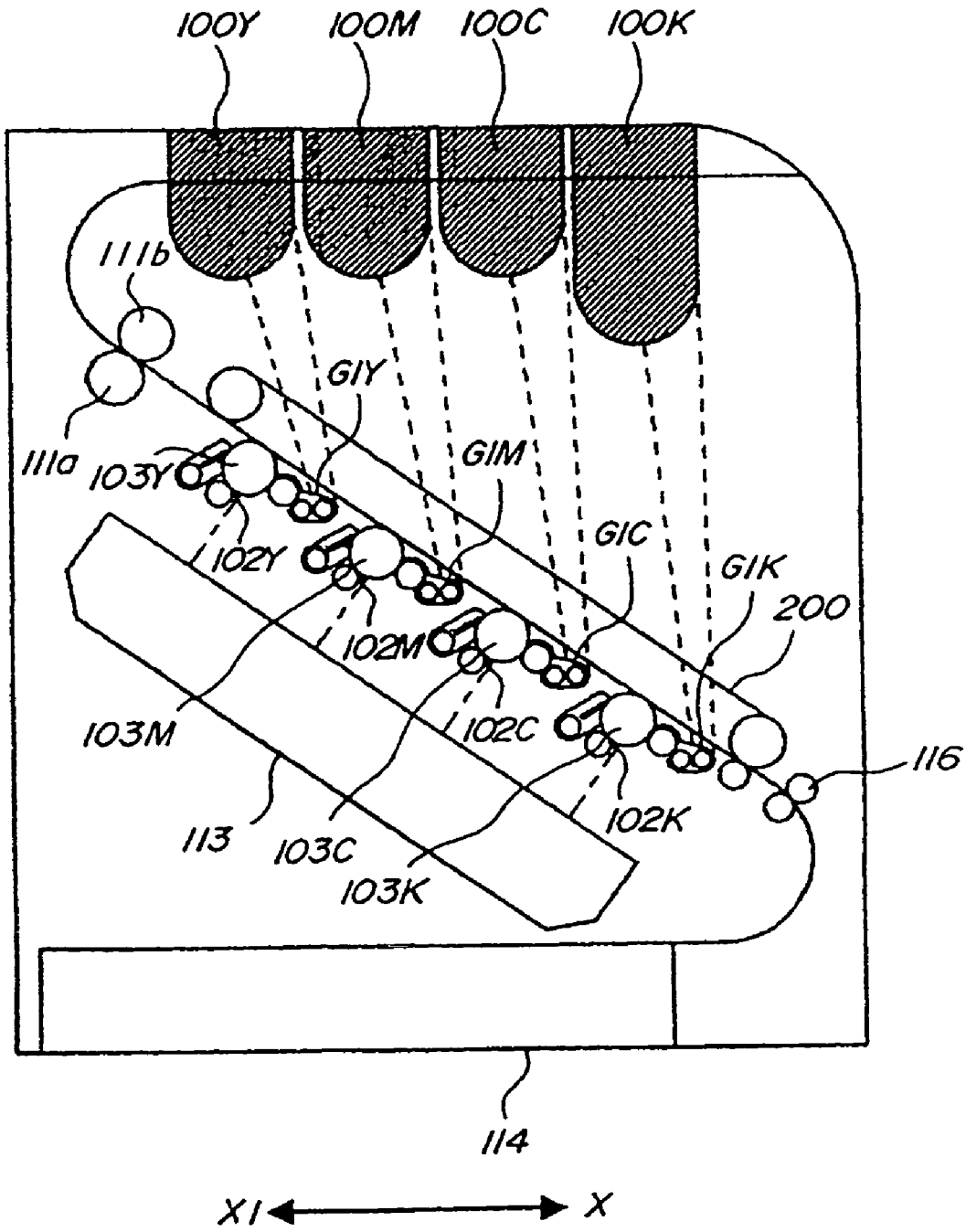
FIG. 12 is a schematic sectional view illustrating an image forming apparatus according to a second embodiment.

For example, the image forming apparatus shown in FIG. 12 includes a transportation belt 200 as a belt member, which rotates in confrontation with the photosensitive drums 103 and whose surface confronting the photosensitive drums 103 inclines at a predetermined angle with respect to a horizontal surface. Then, image forming stations, on which process cartridges 102Y, 102M, 102C, and 102K and toner cartridges 100Y, 100M, 100C, and 100K can be detachably mounted, are disposed along the transportation belt 200 disposed in inclination.

In the second embodiment, a transfer material is electrostatically absorbed to the transportation belt 200, and toner images having respective colors and formed on the photosensitive drums 103 are sequentially superimposed and transferred onto the transfer material.

The black process cartridge 102K is disposed at a lowest vertical position also in the image forming apparatus. Further, a toner supply position G1K at which toner is supplied from the black toner cartridge 100K to the development means of a corresponding process cartridge is also disposed at a lowest vertical position. With this arrangement, the vertical size of the black toner cartridge 100K can be made larger than those of the other color toner cartridges 100Y, 100M, and 100C.

Note that, in the second embodiment, the sizes of the four toner cartridges 100Y, 100M, 100C, and 100K are the same in the front to back direction of the apparatus (in the directions of arrows X-X1 in FIG. 12) and in the right to left direction thereof, which is the rotational axis direction of the photosensitive drums perpendicular to the front to back direction. That is, the toner cartridges 100Y, 100M, 1000C, and 100K have the same profile when they are projected onto the horizontal surface. With this arrangement, it is possible to cause the adjacent intervals between the toner cartridges 100Y, 100M, 1000C, and 100K to coincide with the adjacent intervals of toner supply ports located at toner supply ports G1Y, G1M, G1C, and G1K. Accordingly, a toner supply mechanism can be partly arranged commonly.

In the second embodiment, the toner cartridges 100Y, 100M, and 100C other than the black toner cartridge 100K are composed of the same part having the same capacity and the same shape. As described above, the cost of the toner cartridges for the three colors and the cost of a toner filing process can be reduced by arranging the three toner cartridges commonly.

Third Embodiment

Next, an image forming apparatus according to a third embodiment will be described with reference to FIGS. 13 and 14. Note that since the basic arrangement of the image forming apparatus of the third embodiment is the same as that of the first embodiment described above, a duplicate description thereof is omitted, and only the arrangements characteristic to the third embodiment will be described. Further, the members of the third embodiment having the same functions as those of the first embodiment described above are denoted by the same reference numerals.

Figure 13:
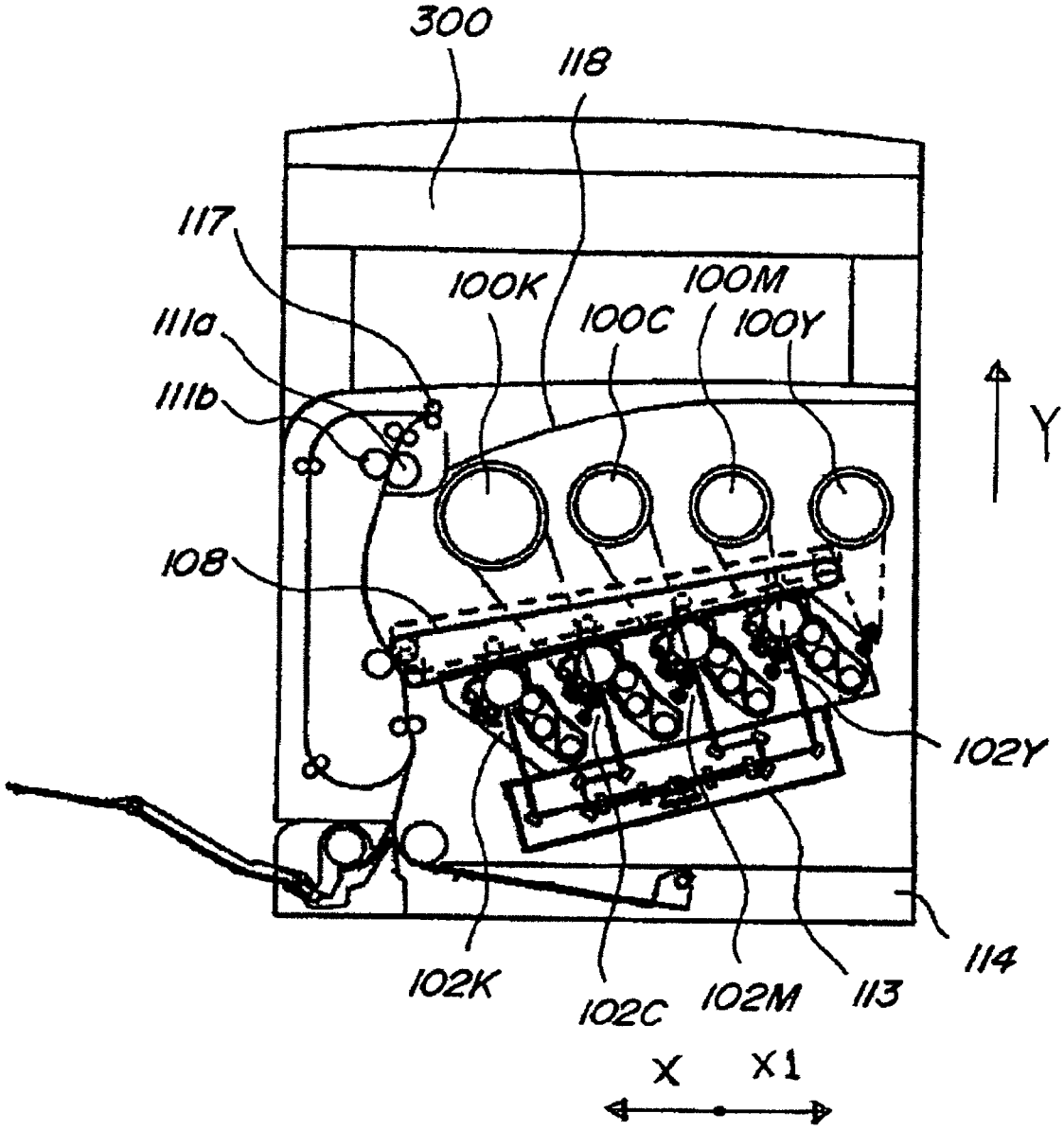
FIG. 13 is a schematic sectional view illustrating an image forming apparatus according to a third embodiment.
Figure 14:
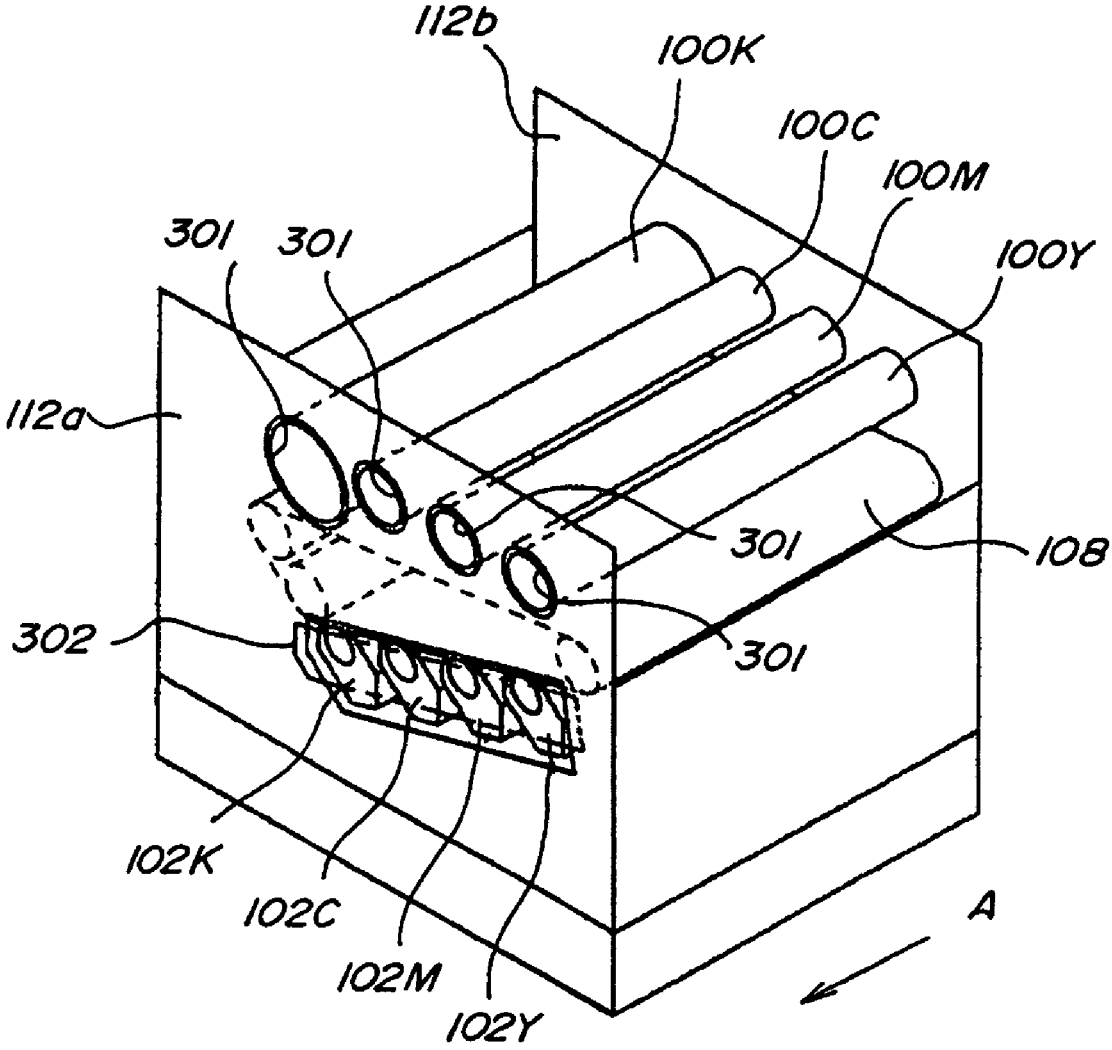
FIG. 14 is a perspective view illustrating the image forming apparatus according to the third embodiment when it is viewed from a front side.
Figure 15:
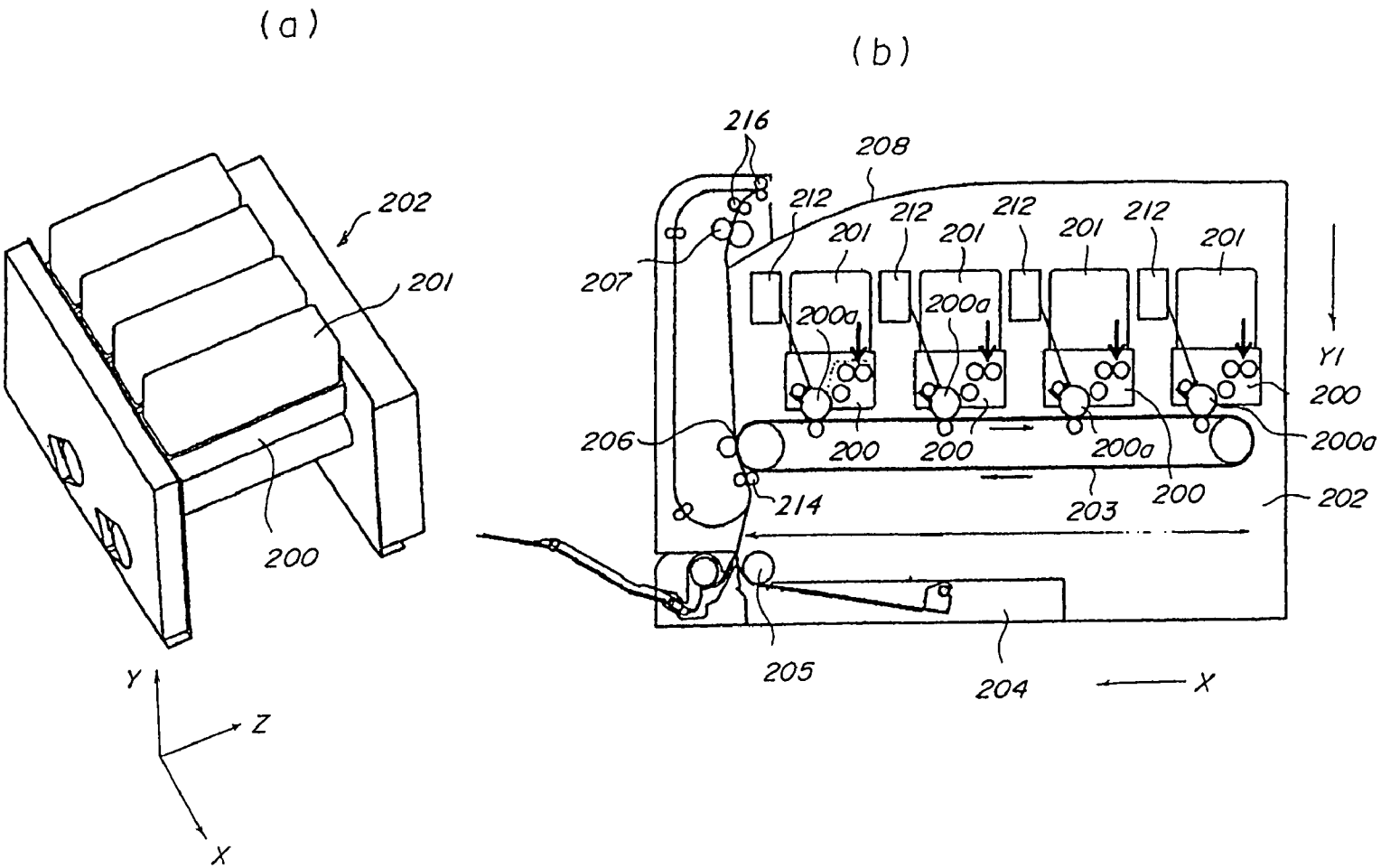
FIG. 15 is a view illustrating the conventional art.

FIG. 13 is a schematic sectional view illustrating the image forming apparatus according to the third embodiment, and FIG. 14 is a perspective view illustrating the image forming apparatus when it is viewed from a front side.

The image forming apparatus of the third embodiment is arranged as a so-called copy machine having a document reader 300 disposed to an upper section of the main body thereof.

The third embodiment is different from the first embodiment in that a transfer material shown in FIG. 13 is transported from a lower portion of the apparatus vertically upward on the front side of an apparatus main body. That is, as shown in FIG. 14, process cartridges 102Y, 102M, 102C, and 102K and toner cartridges 100Y, 100M, 100C, and 100K are interposed between main body frames 112 (112*a* and 112*b*). Although the four toner cartridges 100Y, 100M, 100C, and 100K of the first embodiment are disposed externally of the main body frame 112, cylindrical vessels having approximately the same size in the direction of an arrow A are disposed in approximately the entire region between the main body frames 112*a* and 112*b*.

When the toner cartridges 100Y, 100M, 100C, and 100K and the 102Y, 102M, 102C, and 102K are taken out from the apparatus main body, they can be independently drawn out in the direction of the arrow A through the openings 301 and 302 of the front main body frame 112*s* as shown in FIG. 14. Note that the 102Y, 102M, 102C, and 102K are drawn out from the apparatus main body after an intermediate transfer belt 108 is evacuated to the position of a broken line as shown in FIG. 13.

The process cartridge 102K for forming a black image is disposed at a lowest vertical position also in the image forming apparatus, and a toner supply position at which toner is supplied from the black toner cartridge 100K to a development unit is disposed at a lowest vertical position also in the third embodiment. With this arrangement, the vertical size (in a Y-direction) of the black toner cartridge 100K can be made larger than those of the other color toner cartridges 100Y, 100M, and 100C In the third embodiment, the size of the black toner cartridge 100K in an X-direction is also made larger than those of the other toner cartridges 100Y, 100M, and 100C. Accordingly, the toner capacity of the black toner cartridge 100K can be made larger than those of the other toner cartridges 100Y, 100M, and 100*c*.

OTHER EMBODIMENTS

Although black is designated as the specific color, and yellow, magenta, and cyan other than the black are designated as the non-specific colors in the embodiments described above, any color other than the black may be designated as the specific color. That is, a process cartridge for forming an image of a specific color having high frequency of use is disposed vertically lower than the process cartridges for forming images of other colors. Cartridge replacement frequency can be reduced by increasing the capacity of the toner cartridge of the specific color corresponding to the above process cartridge.

Further, the three image forming stations for forming toner images of yellow, magenta, and cyan colors are exemplified as the non-specific color image forming stations in the embodiments described above. However, when an image of six colors is recorded, five non-specific color stations are employed. Accordingly, one or more non-specific color stations are necessary, and the non-specific color stations need not be limited to the three stations as in the embodiment described above.

Although the embodiments described above show the example in which each of the process cartridges includes the photosensitive drum 103, the primary charger 104, the development means 105, the drum cleaner 107 for removing the toner remaining on the photosensitive drum, and the waste toner transport means 134 for transporting the waste toner removed by the drum cleaner 107, it is sufficient for the process cartridge to include at least the photosensitive drum 103 and the development means 105. Accordingly, in the other modes of the process cartridge, the photosensitive drum, the development means, and the drum cleaner are arranged integrally with each other, the photosensitive drum, the development means, and the primary charge means are arranged integrally with each other, and the photosensitive drum and the development means are arranged integrally with each other.

CROSS-REFERENCE TO RELATED APPLICATION

This application claims the benefit of priority from the prior Japanese Patent Application No. 2004-178621 filed on Jun. 16, 2004 and No. 2005-114238 filed on Apr. 12, 2005 the entire contents of which are incorporated herein by reference.

What is claimed is:

1. An image forming apparatus comprising:

a plurality of image forming stations each including a rotatable image bearing member which bears an electrostatic image, a development device which develops the electrostatic image, and a transfer device which transfers a developer image developed by the development device onto a transfer medium in a transfer section;

a plurality of developer storage containers detachably attached to an apparatus main body, and each storing a supplying developer corresponding to each of the plurality of image forming stations; and a developer supplying device supplying the supplying developer stored in each of the plurality of developer storage containers to a developer supply position of a corresponding one of the image forming stations, wherein the image forming stations are arranged so as to differ from one another in a horizontal position of the transfer section, and so that a vertical position of at least one of the transfer sections differs from vertical positions of other transfer sections, at least the image bearing member and the development device in each of the plurality of image forming stations are configured as a process cartridge detachable from the apparatus main body, wherein the plurality of developer storage containers are aligned to be adjacent to one another, wherein the capacity of the developer storage container corresponding to the image forming station whose transfer section is located in a lowermost position in a vertical direction is larger than the capacity of the developer storage container corresponding to the image forming station whose transfer section is located above the lowermost transfer section in the vertical direction, wherein the developer storage container corresponding to the image forming station whose transfer section is located at the lowermost position in the vertical direction is located downstream of the developer storage container corresponding to the image forming station whose transfer section is located above the lowermost transfer section with respect to a horizontal component of a detachment direction in which said process cartridge is detached from the image forming apparatus, and wherein a central position in the horizontal direction, perpendicular to the rotational axis of the image bearing member, and perpendicular to the vertical direction, of the developer storage container corresponding to the image forming station whose transfer section is located at the lowermost position in the vertical direction is located downstream of the developer supply position corresponding to the image forming station whose transfer section is located at the lowermost position in the vertical direction with respect to the horizontal component of the detachment direction, wherein a central position in the horizontal direction, perpendicular to the rotational axis of the image bearing member, and perpendicular to the vertical direction, of the developer storage container corresponding to the image forming station having the transfer section at the lowest position is located downstream in the horizontal component of the detachment direction, of the rotational axis of the image bearing member of the image forming station having the transfer position at the lowest position, and wherein a central position in the horizontal direction, perpendicular to the rotational axis of the image bearing member, and perpendicular to the vertical direction, of the developer storage container corresponding to the image forming station having a transfer section positioned higher than the transfer section at the lowest position is located upstream in the horizontal component of the detachment direction, of the rotational axis of the image bearing member of the image forming station having the transfer section positioned higher than the transfer section at the lowest position.

2. The image forming apparatus according to claim 1, comprising a rotatable belt member which faces the image bearing member of each image forming station, wherein the belt member is arranged such that a plane of the belt member is inclined with respect to the horizontal direction, the plane of the belt member facing the plurality of image bearing members.

3. The image forming apparatus according to claim 1, wherein a vertical length of the developer storage container corresponding to the image forming station whose transfer section is located in the lowermost position in the vertical direction is longer than a vertical length of the developer storage container corresponding to the image forming station whose transfer section is located above the lowermost transfer section in the vertical direction.

4. The image forming apparatus according to claim 3, wherein an upper end portion of the developer storage container corresponding to the image forming station whose transfer section is located in a lowermost position in the vertical direction is located at the substantially same vertical position as an upper end portion of the developer storage container corresponding to the image forming station whose transfer section is located above the lowermost transfer section in the vertical direction.

5. The image forming apparatus according to claim 1, wherein the image forming station whose transfer section is located in the lowermost position in the vertical direction forms a black image, and black toner is stored in the developer storage container corresponding to the image forming station whose transfer section is located in the lowermost position in the vertical direction.

6. The image forming apparatus according to claim 1, the plurality of developer storage containers, except the developer storage container corresponding to the image forming station whose transfer section is located in a lowermost position in a vertical direction, respectively have different shaped key portions for preventing the developer storage containers from being mounted erroneously, and have the same shape as a whole.

* * * * *